US006234443B1

(12) United States Patent
Tsai et al.

(10) Patent No.: US 6,234,443 B1
(45) Date of Patent: May 22, 2001

(54) BASE FOR CHRISTMAS TREE

(76) Inventors: Yuan-Hui Tsai, 56, Tzyh-Li Rd., Nankan Industrial Dis., Nantou (TW); Anthony Decosmo, 5427 Wellfield Rd., New Port Richey, FL (US) 34655

( * ) Notice: Subject to any disclaimer, the term of this patent is extended or adjusted under 35 U.S.C. 154(b) by 0 days.

(21) Appl. No.: 09/453,067

(22) Filed: Dec. 2, 1999

(51) Int. Cl.[7] ..... F16M 13/00
(52) U.S. Cl. ..... 248/519
(58) Field of Search ..... 248/519, 539, 248/523, 529, 188.7, 165, 436

(56) References Cited

U.S. PATENT DOCUMENTS 3,787,018 * 1/1974 Nathan ..... 248/165
4,032,098 * 6/1977 Marschak ..... 248/165
4,261,138 * 4/1981 St. George Syms ..... 248/523 X
4,288,052 * 9/1981 Scott ..... 248/188.7 X
4,921,190 * 5/1990 Russo et al. ..... 248/159

* cited by examiner

*Primary Examiner*—Ramon O. Ramirez
(74) *Attorney, Agent, or Firm*—Bacon & Thomas, PLLC

(57) ABSTRACT

A base is designed to support a Christmas tree on the floor. The base comprises an upright main body, an upper seat fitted into the top end of the upright main body for holding the Christmas tree, a sleeve fitted over the upright main body, a lower seat fitted into the bottom end of the upright main body, and three legs for supporting the main body in the upright position such that an upper support rod of each of the three legs is releasably retained by the sleeve, and that a lower support rod of each of the three legs is releasably retained by the lower seat.

1 Claim, 4 Drawing Sheets

BASE FOR CHRISTMAS TREE

FIELD OF THE INVENTION

The present invention relates generally to a Christmas tree, and more particularly to a base of the Christmas tree.

BACKGROUND OF THE INVENTION

The artificial or natural Christmas tree is supported on the floor by means of a base. There are a variety of conventional bases available in the market place; nevertheless they are generally too complicated in construction to be assembled and disassembled with ease and speed. In addition, the assembly and the disassembly of the conventional bases can not be done without the help of a hand tool.

SUMMARY OF THE INVENTION

The primary objective of the present invention is to provide a Christmas tree base, which is free from the deficiencies of the conventional Christmas tree bases described above.

It is another objective of the present invention to provide a do-it-yourself (DIY) Christmas tree base, which is simple in construction and can be stored easily.

The objectives, features and advantages of the present invention will be readily understood upon a thoughtful deliberation of the following detailed description of a preferred embodiment of the present invention, with reference to the accompanying drawing.

DETAILED DESCRIPTION OF THE PREFERRED EMBODIMENT

Figure 1:
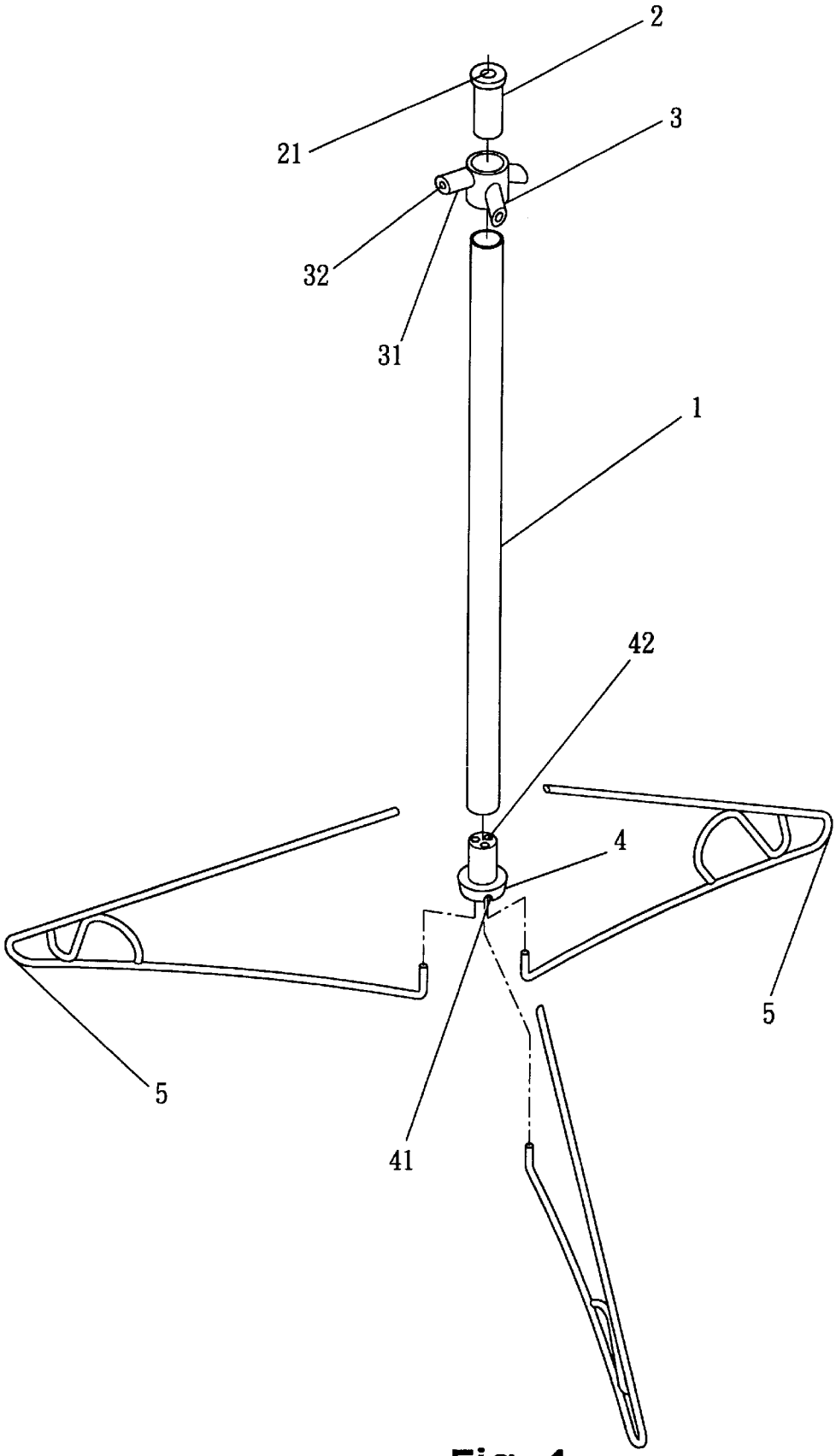
FIG. 1 shows an exploded view of the preferred embodiment of the present invention.
Figure 2:
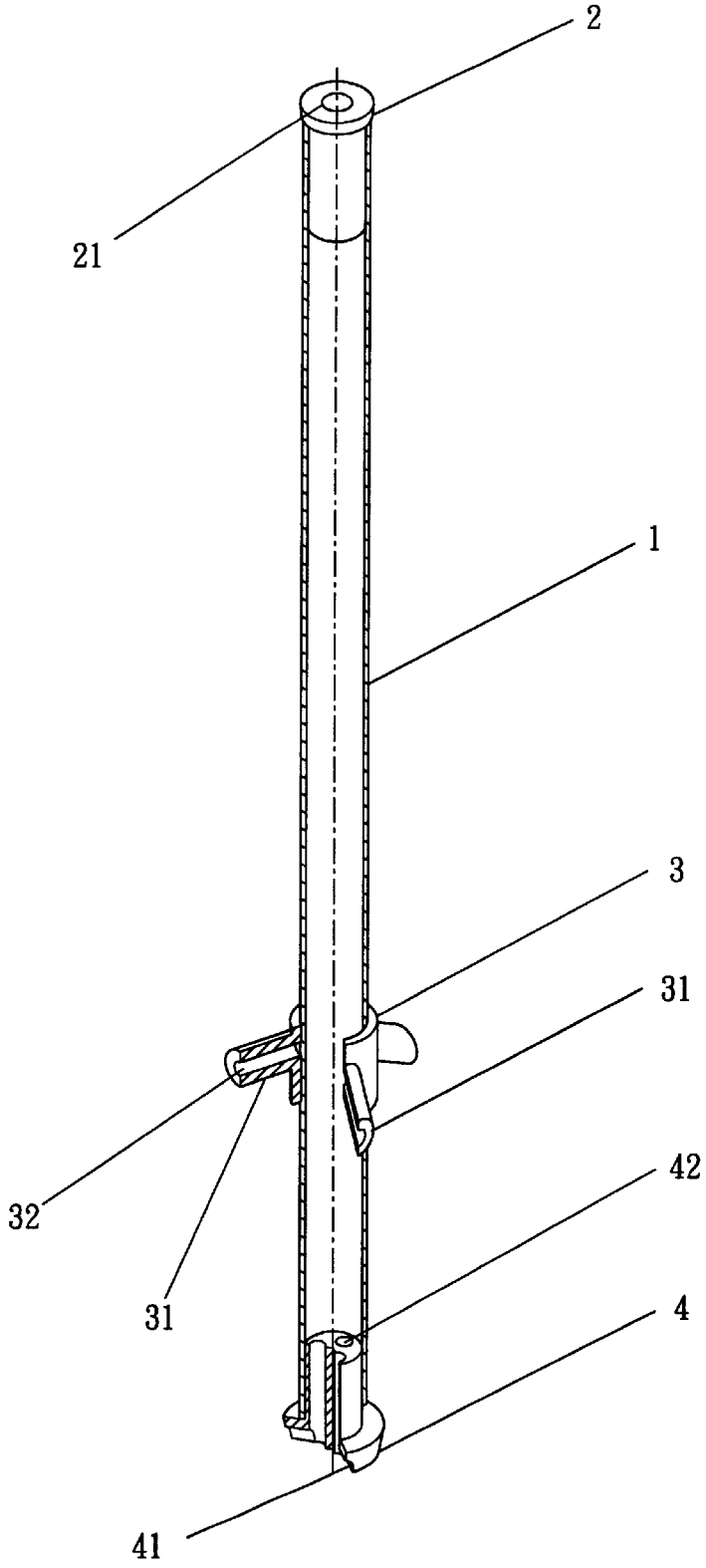
FIG. 2 shows a longitudinal sectional view of the preferred embodiment of the present invention in combination.

As shown in FIGS. 1, 2, 3, and 4, a Christmas tree base of the preferred embodiment of the present invention comprises an upright main body 1, an upper seat 2, a sleeve 3, a lower seat 4, and tree legs 5.

Figure 3:
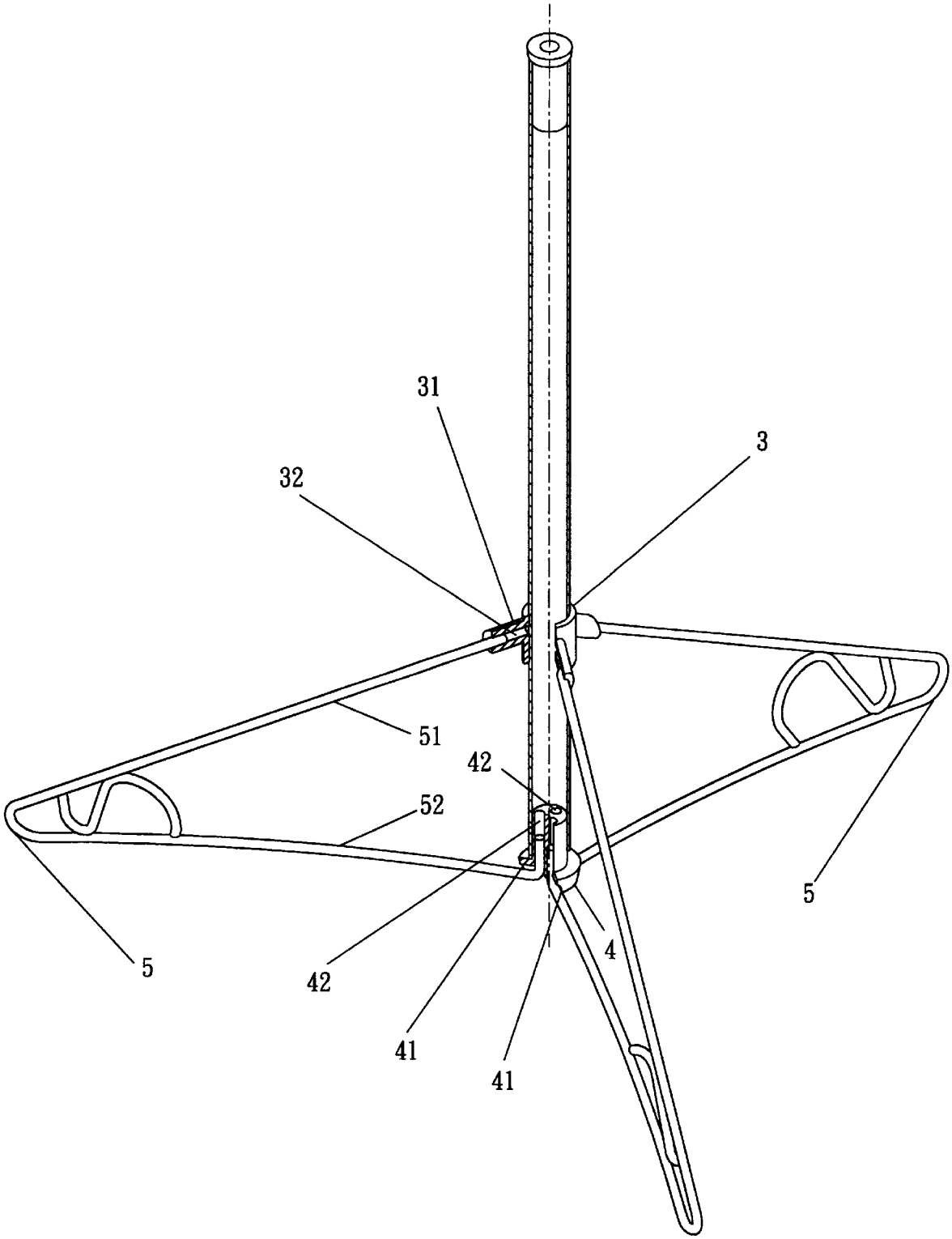
FIG. 3 shows another longitudinal sectional view of the preferred embodiment of the present invention in combination.

The upright main body 1 is of a hollow tubular and open-ended construction. The upper seat 2 is of a tubular construction and is provided with a retaining hole 21 extending along the direction of the longitudinal axis of the tubular upper seat 2. The upper seat 2 is fitted into the top end of the hollow main body 1 for holding the bottom end of a Christmas tree such that the bottom end of the Christmas tree is retained in the retaining hole 21 of the upper seat 2. The sleeve 3 is fitted over the main body 1 such that the sleeve 3 is fixed with the main body 1 by a plurality of rivets (not shown in the drawings). The sleeve 3 is provided in the outer wall thereof with three cylindrical protrusions 31 fastened therewith equidistantly such that the cylindrical protrusions 31 are tilted or directed downwardly when main body 1 is in a vertical position of use. The cylindrical protrusions 31 are each provided in the free end thereof with a retaining socket 32 of a predetermined depth. The lower seat 4 is fixedly fitted into the bottom end of the upright main body 1. The lower seat 4 is provided with three separate L-shaped apertures, each including a horizontal slot 41 and a vertical socket 42, and which correspond in location to the three cylindrical protrusions 31 of the sleeve 3. The axes of the horizontal slots 41 and the vertical socket 42 are perpendicular to each other. The three legs 5 are corresponding in construction to one another and are each formed by an upper inclined support rod 51 and a lower horizontal support rod 52. As shown in FIG. 3, the free end the upper support rod 51 is straight and terminates in a free end that is retained in one of the three retaining sockets 32 of the sleeve 3, whereas the free end of the lower support rod 52 turned end sockets. The upturned end of support rod 52 is substantially perpendicular to rod 52 such that the upturned end is positioned vertically when rod 52 is positioned horizontally in a position of use. The upturned end is received in vertical socket 42 and the horizontal portion of rod 52 is secured within horizontal slot 41. This results in an extremely rigid and secure engagement of each leg 5 to main body 1. The main body 1 is thus supported uprightly on the floor by the three legs 5 which are arranged equiangularly.

The Christmas tree base of the present invention can be easily folded by pulling the free end of the lower support rod 52 of each leg 5 out of the vertical slot 42 and the horizontal slot 41 of the lower seat 4. In the meantime, the free end of the upper support rod 51 of each leg 5 can be easily pulled out of the retaining slot 32 of one of the three cylindrical protrusions 31 of the sleeve 3.

Figure 4:
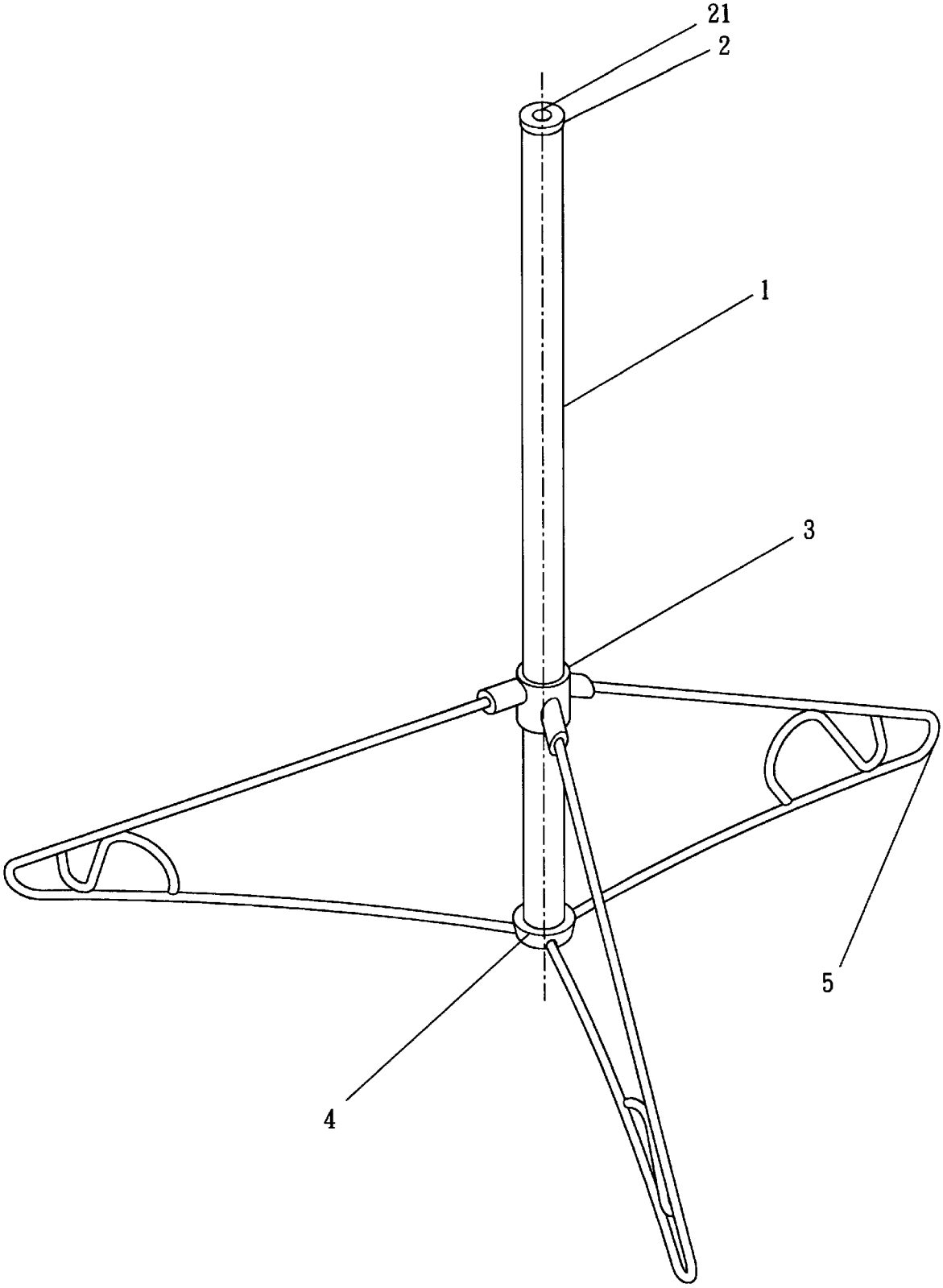
FIG. 4 shows a perspective view of the preferred embodiment of the present invention in combination.

As shown in FIG. 4, the main body I is supported uprightly by a tripod which is formed of three legs 5. The bottom end of a Christmas tree trunk is retained in the retaining hole 21 of the upper seat 2.

The present invention is relatively simple in construction such that it is completely devoid of nuts and bolts, and that it can be easily assembled and disassembled without the help of a hand tool. In addition, the Christmas tree base of the present invention can be easily stored in a relatively small space.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claim.

What is claimed is:

1. A base for supporting a Christmas tree, the base comprising:

(a) a hollow tubular main body having an open top end and an open bottom end;

(b) a tubular upper seat engagable with the open top end for supporting the bottom end of a tree trunk;

(c) a sleeve mounted on the main body in a fixed position between the top and bottom ends, three cylindrical protrusions spaced around and extending outwardly and downwardly from the sleeve, each protrusion including a downwardly facing retaining socket formed therein;

(d) a tubular lower seat engagable within the open bottom end of the main body, the lower seat including three spaced L-shaped apertures corresponding in position to the three cylindrical protrusions, each L-shaped aperture being defined by a horizontal slot and a vertical socket;

(e) three legs, each leg including an inclined support rod and a horizontal support rod, the inclined support rod terminating in a straight end and the horizontal support rod terminating in an upturned end; and (f) the straight end of each inclined support rod being engagable within one of the downwardly directed retaining sockets and the upturned end of each horizontal support rod being engagable within a corresponding one of said L-shaped apertures for securing and rigidly attaching the legs to the main body of the stand.

* * * * *